US006575597B1

(12) United States Patent
Cramer et al.

(10) Patent No.: US 6,575,597 B1
(45) Date of Patent: Jun. 10, 2003

(54) NON-LETHAL VISUAL BIRD DISPERSAL SYSTEM

(75) Inventors: Eric J. Cramer, Albuquerque, NM (US); Michael D. Tocci, Sandia Park, NM (US)

(73) Assignee: Science & Engineering Associates, Inc., Albuquerque, NM (US)

( * ) Notice: Subject to any disclaimer, the term of this patent is extended or adjusted under 35 U.S.C. 154(b) by 0 days.

(21) Appl. No.: 09/785,701

(22) Filed: Feb. 16, 2001

Related U.S. Application Data

(63) Continuation-in-part of application No. 09/409,328, filed on Sep. 30, 1999, now Pat. No. 6,190,022, which is a continuation-in-part of application No. 08/967,426, filed on Nov. 10, 1997, now Pat. No. 6,007,218, which is a continuation-in-part of application No. 08/518,230, filed on Aug. 23, 1995, now Pat. No. 5,685,636.

(60) Provisional application No. 60/135,231, filed on May 21, 1999.

(51) Int. Cl.[7] ..... F21K 7/00; E04H 9/16; F21V 21/30

(52) U.S. Cl. ..... 362/259; 362/35; 52/101; 116/22 A

(58) Field of Search ..... 43/1; 52/101; 116/22 A; 119/713, 908; 340/573.2; 362/35, 234, 253, 287, 418, 259

(56) References Cited

U.S. PATENT DOCUMENTS

| | | | | | |
|---|---|---|---|---|---|
| 2,353,082 | A | * | 7/1944 | Roedding et al. | 362/250 |
| 3,013,145 | A | * | 12/1961 | Trippe | 362/35 |
| 3,062,144 | A | * | 11/1962 | Hori et al. | 102/430 |
| 4,048,631 | A | | 9/1977 | Flores | 362/184 |
| 4,736,907 | A | * | 4/1988 | Steffen | 43/1 |
| 4,963,798 | A | | 10/1990 | McDermott | 362/231 |
| 5,072,342 | A | | 12/1991 | Minovitch | 362/111 |
| 5,243,894 | A | | 9/1993 | Minovitch | 89/1.11 |
| 5,319,367 | A | * | 6/1994 | Schulte et al. | 362/470 |
| 5,375,043 | A | | 12/1994 | Tokunaga | 362/231 |
| 5,417,573 | A | | 5/1995 | Cassiere, II et al. | 434/21 |
| 5,450,063 | A | * | 9/1995 | Peterson et al. | 340/573.2 |
| 5,527,308 | A | | 6/1996 | Anderson et al. | 606/14 |
| 5,584,137 | A | | 12/1996 | Teetzel | 42/103 |
| 5,685,636 | A | | 11/1997 | German | 362/259 |
| 5,713,654 | A | | 2/1998 | Scifres | 362/259 |
| 5,734,504 | A | | 3/1998 | Billman | 359/618 |
| 5,761,235 | A | | 6/1998 | Houde-Walter | 372/77 |
| 5,808,226 | A | | 9/1998 | Allen et al. | 89/1.11 |
| 5,814,041 | A | | 9/1998 | Anderson et al. | 606/15 |
| 6,007,218 | A | | 12/1999 | German et al. | 362/259 |
| 6,007,219 | A | | 12/1999 | O'Meara | 362/259 |
| 6,190,022 | B1 | | 2/2001 | Tocci et al. | 362/259 |
| 6,367,943 | B1 | | 4/2002 | Tocci et al. | 362/103 |

FOREIGN PATENT DOCUMENTS

| | | | | |
|---|---|---|---|---|
| FR | 2662234 | * | 11/1991 | 362/210 |
| JP | 406284847 A | * | 10/1994 | 52/101 |
| JP | 09070250 A | * | 3/1997 | |
| WO | WO 97/08489 | | 3/1997 | |
| WO | WO 99/24755 | | 5/1999 | |

* cited by examiner

*Primary Examiner*—Alan Cariaso
(74) *Attorney, Agent, or Firm*—Perkins, Smith & Cohen, LLP; Jacob N. Erlich

(57) ABSTRACT

A non-lethal method and devices for dispersing nuisance birds from a preselected area. Such nuisance birds disrupt many activities such as the steady flow of safely moving aircraft on runways and adjacent thereto, growing crops on farm land, playing golf and the use of the interior of large open buildings. The present method utilizes a series of bright light sources which are positioned adjacent the area from which the birds are to be dispersed. The light sources are activated to produce one or more beams of bright light which are moved in such a manner to produce a pattern of bright light in the vicinity of the birds to be dispersed. This action causes the birds to become sufficiently startled and disoriented so as to disperse these nuisance birds from the area to be cleared.

2 Claims, 14 Drawing Sheets

GOLF COURSE, FARM LAND, AIRFIELD, ETC.

NON-LETHAL VISUAL BIRD DISPERSAL SYSTEM

CROSS REFERENCE TO RELATED APPLICATIONS

This invention is a continuation-in-part of and claims priority of U.S. patent application Ser. No. 09/409,328 filed Sep. 30, 1999 now U.S. Pat. No. 6,190,022 entitled ENHANCED NON-LETHAL VISUAL SECURITY DEVICE which claims priority of Provisional Application Ser. No. 60/135,231 filed May 21, 1999 and which in turn is a continuation-in-part of U.S. patent application Ser. No. 08/967,426 filed Nov. 10, 1997 entitled SELF-CONTAINED LASER ILLUMINATOR MODULE now U.S. Pat. No. 6,007,218 which is a continuation-in-part of U.S. patent application Ser. No. 08/518,230 filed Aug. 23, 1995 entitled EYE SAFE LASER SECURITY DEVICE now U.S. Pat. No. 5,685,636. A PCT application Ser. No. PCT/US98/01662 was filed on Jan. 29, 1998 based upon U.S. patent application Ser. No. 08/967,426. Another PCT Application Serial No. PCT/US96/13556 is based upon U.S. patent application Ser. No. 08/518,230.

BACKGROUND OF THE INVENTION

This invention relates generally to a bird dispersal methodology and device and, more particularly, to non-lethal, eye-damaging bird dispersal methods and devices based on intense light to provide a means of dispersing nuisance birds.

Birds in general pose serious problems in several areas of society. These problems range from the physical presence of birds, such as birds roosting on or near airport runways, increasing the probability of bird/aircraft strikes, to property damage resulting from bird excrement on equipment or structures.

In recent years, due to changes in land use, climate changes, and cultural practices, populations of several avian species has increased. Associated with this increase in population, is damage to property as well as increased risks to human health and safety. Although these problems are on the rise, the number of management options available to control birds has been limited to non-lethal approaches.

There are three primary areas of concern with nuisance birds: 1) potential of injury or death and associated property damage from bird strikes on aircrafts; 2) damage to property from bird excrement and nesting materials inside warehouses, public parks, golf courses, aircraft hangers, buildings, and rooftops; and 3) the depredation of crops in the agriculture and aquaculture industries. The impact nuisance birds have on these areas is primarily economic. Any means to limit the number of birds in these areas and the associated damages is of great value. Past bird dispersal techniques generally employed the use of high volume audible alarms or explosives to disperse birds. These devices, however, were limited to rural areas where the intense noise did not disturb residents.

It is therefore an object of this invention to provide a method to control and disperse nuisance birds through the use of intense light without causing harm to individuals that may be in close proximity to or inadvertently exposed to the light.

It is another object of this invention to provide a non-lethal, visual bird dispersal device that is capable of low cost manufacture.

It is still another object of this invention to provide a non-lethal, visual bird dispersal device that is extremely effective as an avian repellent under a wide range of conditions.

It is a further object of this invention to provide a non-lethal, visual bird dispersal device that is capable of automated, unmanned operation in a wide range of conditions.

SUMMARY OF THE INVENTION

The objects set forth above as well as further and other objects and advantages of the present invention are achieved by the embodiments of the invention described herein below.

The present invention provides a system and method of using intense light for the purpose of dispersing nuisance birds. The method incorporates therein, but not limited to, the inclusion therein of a device or plurality of devices capable of producing cost effective laser light directly from a laser diode source or light from light emitting diodes (LED's), as well the incorporation of an automated scanning system to facilitate unmanned operation of the device(s).

More specifically, the present invention provides an effective system for projecting light directly from a laser diode source to provide a beam of relative intensity within the Maximum Permissible Exposure (MPE) level as defined by the National Standards Institute. By the addition of an automated scanning system within the present invention, and the method in which it is used, the system can be operated in an autonomous manner allowing for unmanned use.

The use of intense eye-safe light to disperse birds is suitable for use in virtually all rural or urban settings. Different configurations of the projected light can be used to increase effectiveness depending on the intended area of use. For those scenarios where the target area is in an urban setting, or where precise control of the light is required to limit human exposure, the light can be configured as a spot allowing for precise placement of the light on a specific target or individual bird. For those scenarios where the target area is much larger, as in agriculture or aquaculture industry, the light can be configured as a line of appropriate divergence allowing for a single sweep of the device to cover the entire area of interest.

The present method of this invention for nuisance bird dispersal utilizes eye-safe laser security devices such as described in U.S. Pat. Nos. 5,685,636, 6,007,218 and U.S. patent application Ser. No. 09/409,328, all incorporated herein by reference which employ the same light sources at any narrow wavelength band between 400 and 700 nanometers (the entire visible light spectrum from blue to red) and provide either continuous or repetitively pulsed (on-off flashing) light. The present invention addresses the use of eye-safe laser devices in a method suitable for use as a bird dispersal device, either hand held or mounted to an unmanned automated scanning device.

For a better understanding of the present invention, together with other and further objects thereof, reference is made to the accompanying drawings and detailed description and its scope will be pointed out in the appended claims.

DETAILED DESCRIPTION OF THE PREFERRED EMBODIMENTS

In order to better understand the present invention, the following description provides a basic overview of the methodology of this invention followed by a detailed description of the various preferred embodiments of this invention for effecting those concepts in enhanced nonlethal bird dispersal devices.

More specifically, ultra bright light sources offer an effective non-lethal approach to control and disperse birds. The predominant effect generated from the light is psychological. The laser light projects a visible spot, moving or stationary, on or near the target bird(s). This simulates a foreign object in the immediate vicinity of the bird, producing a startle reflex in the bird and causing it to flee. This response alerts and startles other birds in the area causing them to flee as well. The light can also be used to illuminate birds directly, causing them to look into the laser beam. The light produced in the eye of the bird creates an intense light pattern, making the distance to the light source difficult to determine, causing disorientation and confusion.

Figure 1:
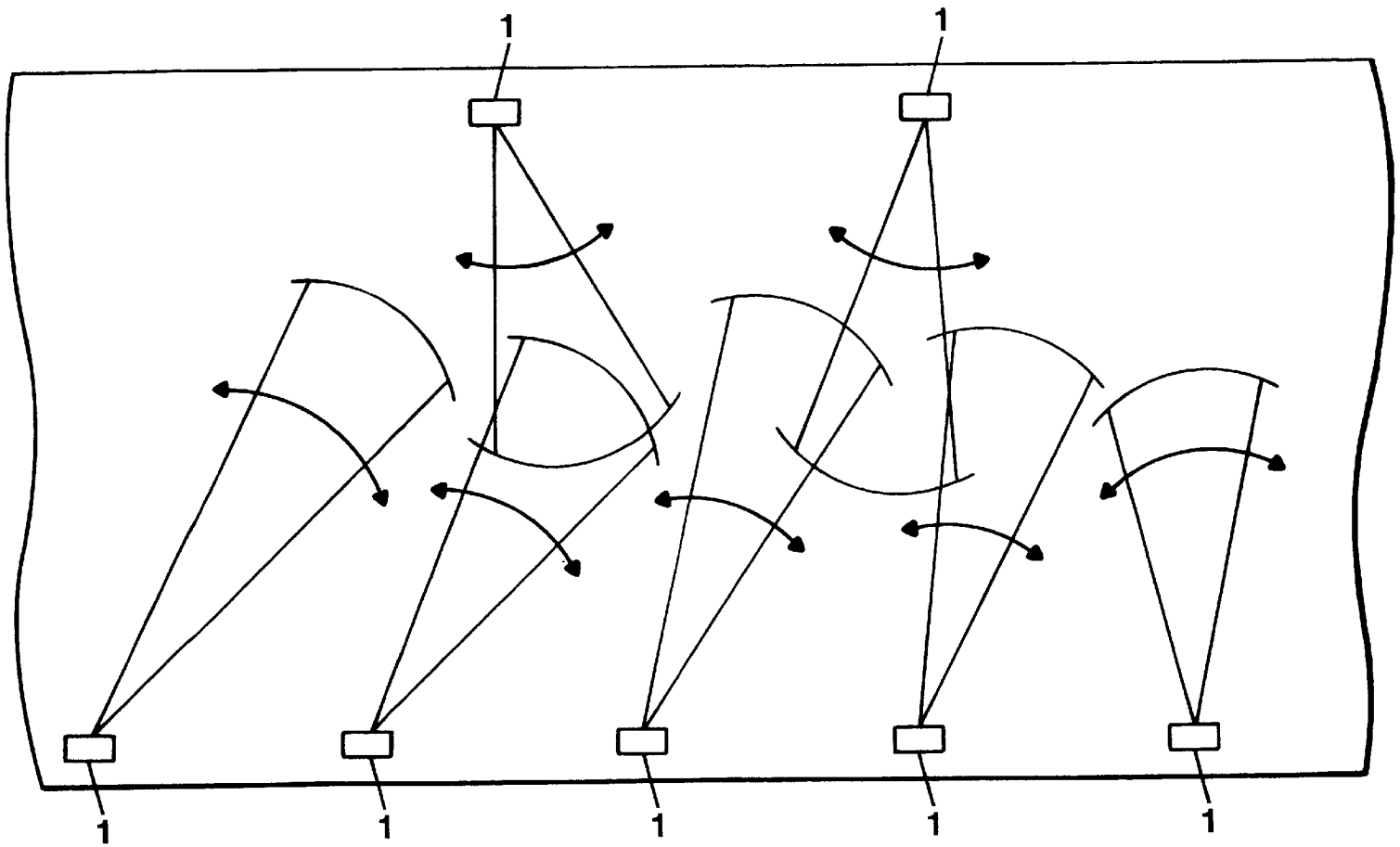
FIG. 1 is a schematic representation of a golf course, farm land and/or air field or the like which incorporates therein the present invention.

One embodiment of the present invention involves the dispersal of nuisance birds on golf courses, farm lands, airfields and the like. FIG. 1 shows one possible configuration of the laser device(s) 1 near a golf course lake where nuisance birds have congregated. The device can be used as a hand held device or automated for unmanned operation. FIG. 1 shows the laser device placed on the ground at a golf course in the immediate vicinity of the birds and is periodically activated to sweep the laser beam across the area of interest. Random motion and activation of the laser beam decrease the likelihood of habituation of the birds to become accustom to the high intensity light source.

Figure 2:
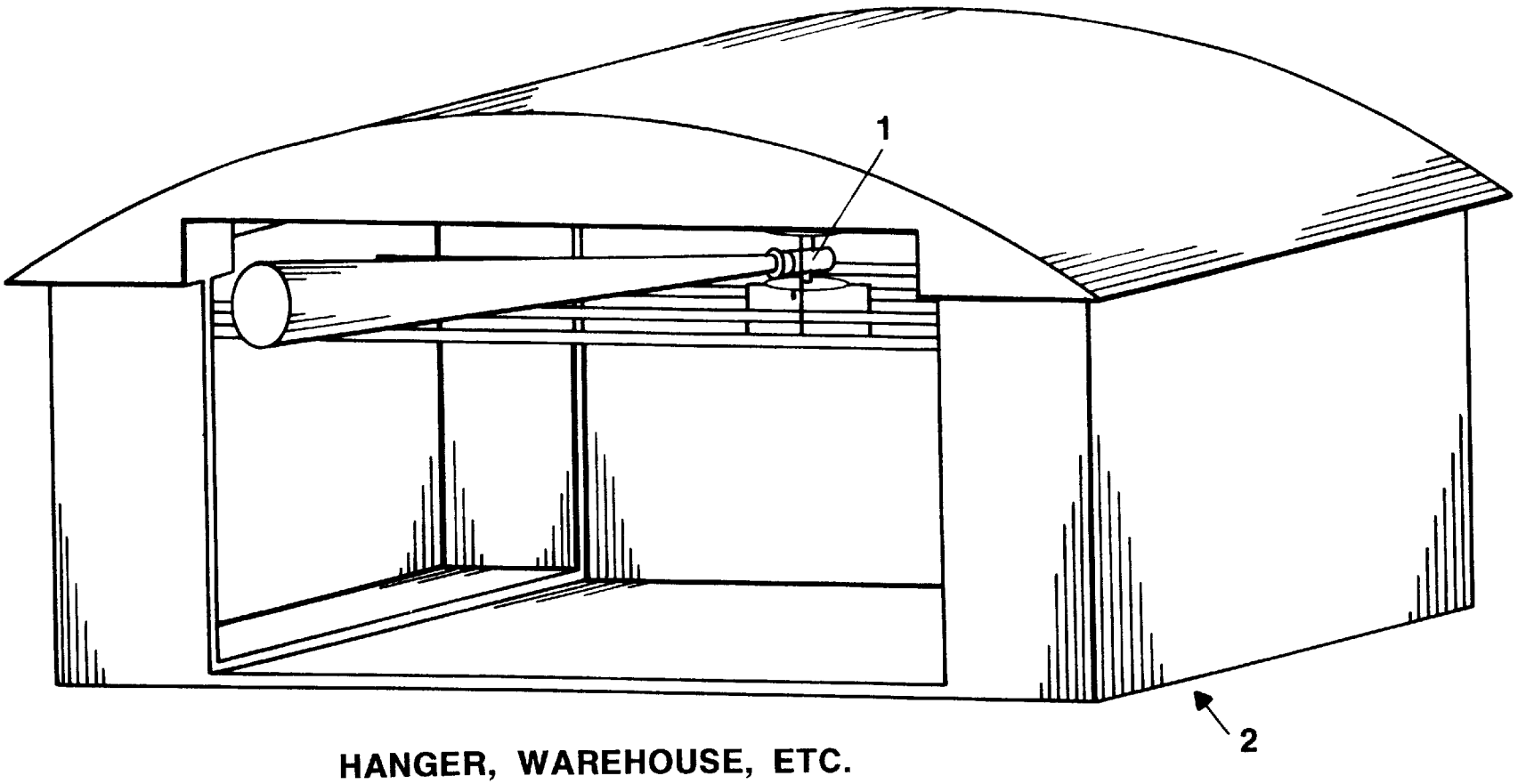
FIG. 2 is a schematic representation of a hanger, warehouse or the like which incorporates therein the present invention.

Another embodiment of the invention incorporates the use of the device(s) 1 in warehouses and airport hangers 2. This concept, shown in FIG. 2, and is utilized to keep birds from nesting or congregating in the rafters inside of structures. Once again the present invention can be used manually from the ground to illuminate and sweep birds out of the building or can be used in the unmanned automated configuration and placed inside the structure in the rafters. Typical operation in this scenario places a single device in the center of the building near the ceiling. At random or predetermined time intervals, the device is swept around the entire ceiling, removing or preventing birds from perching in the rafters. The precise control of the device allows for treatment of a specific area. In this particular case, the device can be directed to dispersing birds from the rafters and not affect normal activities of personnel on the ground. This same concept can also be used on rooftops to avoid nesting of birds in roof mounted mechanical equipment such as heating and cooling systems.

Figure 3:
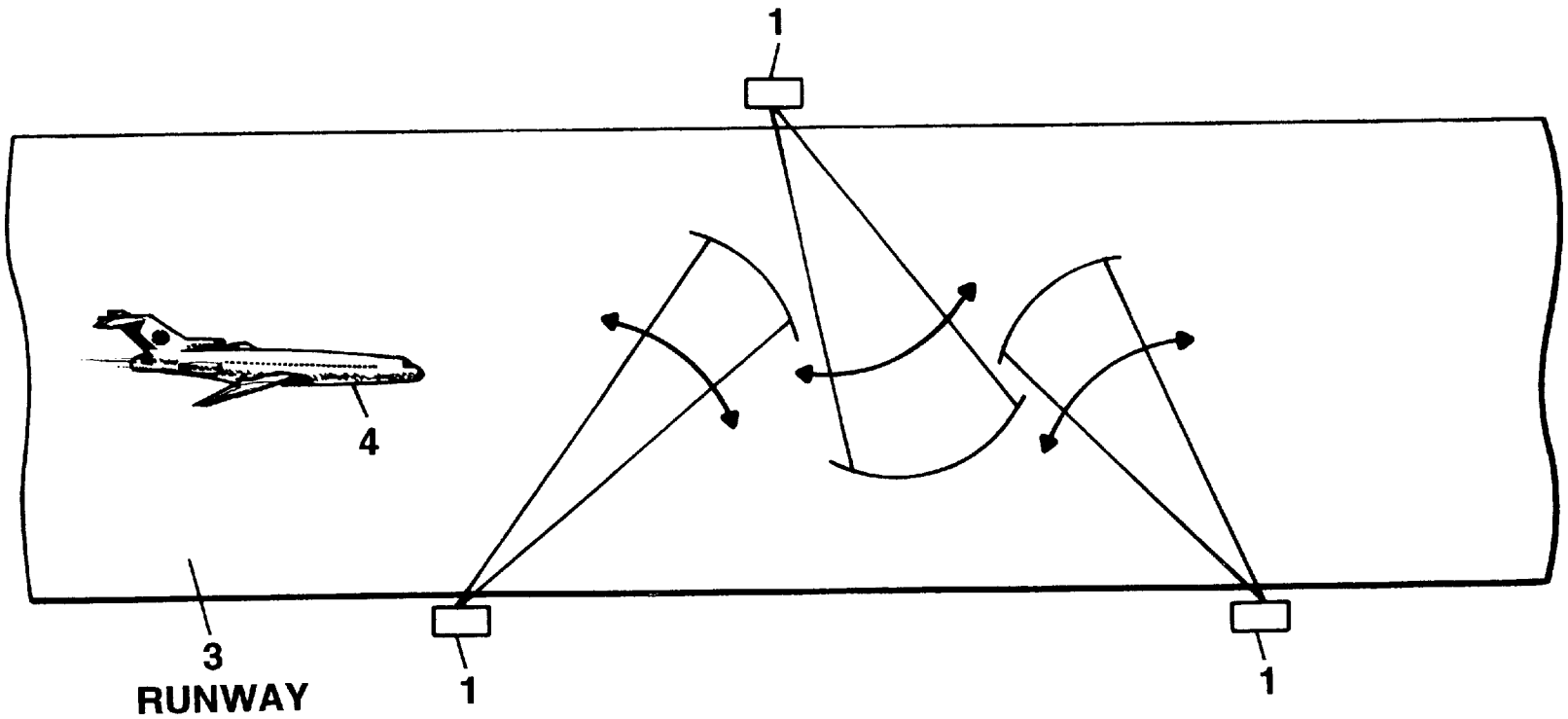
FIG. 3 is a schematic representation of a runway or the like which incorporates therein the present invention.

An additional embodiment of this invention involves the placing of a non-lethal light emitting device(s) 1 adjacent to airport runways 3 to reduce the potential of bird air strikes on planes 4 during take-off and landing. FIG. 3 shows the present invention placed on the ground near typical roosting or nesting areas near the airport. The device is directed to sweep only the area of interest and is directed toward the ground to ensure the device does not disrupt aircraft activities. The primary effect with this scenario is to create an undesirable area for birds to congregate and roost. Several devices may be necessary to effectively reduce bird populations.

Light emitting devices such as the type described in U.S. Pat. Nos. 5,685,636, 6,007,218 and U.S. patent application Ser. No. 09/409,328 all of which being incorporated herein by reference, utilize extremely bright light at predetermined wavelengths, beam diameters, intensities, and flashing patterns to create temporary visual impairment (by glare and/or flashblinding) to cause hesitation, delay, distraction, disorientation, and reductions in functional effectiveness of nuisance birds.

Another preferred embodiment of the present invention utilizes one or more light-emitting diodes (LEDs) in-place of the laser for certain, short-range applications. Light-emitting diodes are non-laser semiconductor light sources that share a laser's ability to emit light of a specific. Recently several ultra-brightness Single LEDs (Gilway Technical Lamp Stock # E184-red, E903-green, E474-blue for example) and LED arrays (Opto Technology Stock # OTL-660A-9-4-66-E-red, OTL530A-3-4-66-E-green, OTL-470A-3-4-66-E-blue for example) have become commercially available. The cost of such single LEDs and LED arrays are considerably less than that of a laser. By the utilization of LEDs and/or LED arrays and their associated circuitry within the device of the present invention, the present invention takes advantage of such cost savings.

When the intensity of visible light at the eye exceeds a certain level, injury to the retina can occur in the form of lesions (i.e. small burns) at the focal spot of the light. To ensure that the device of the present invention is non-damaging to the human eye of persons in the path thereof, the intensity present at the subject's eye must be below the Maximum Permissible Exposure (MPE) as defined in ANSI Z136.1 published by the American National Standards Institute. For continuous or flashing light sources utilized within such security devices, the exposure level is measured in watts per square centimeter. If the laser intensity anywhere within the beam diameter exceeds the MPE, the possibility of retinal injury exists.

Figure 4B:
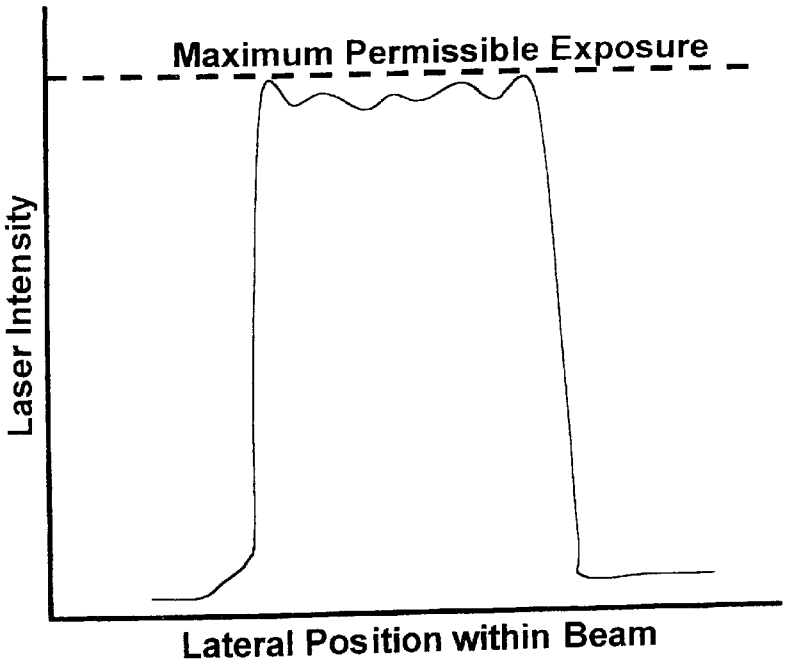
FIG. 4*b* is a graphic representation of a laser output beam having an intensity peak substantially flat across its entire diameter.
Figure 4A:
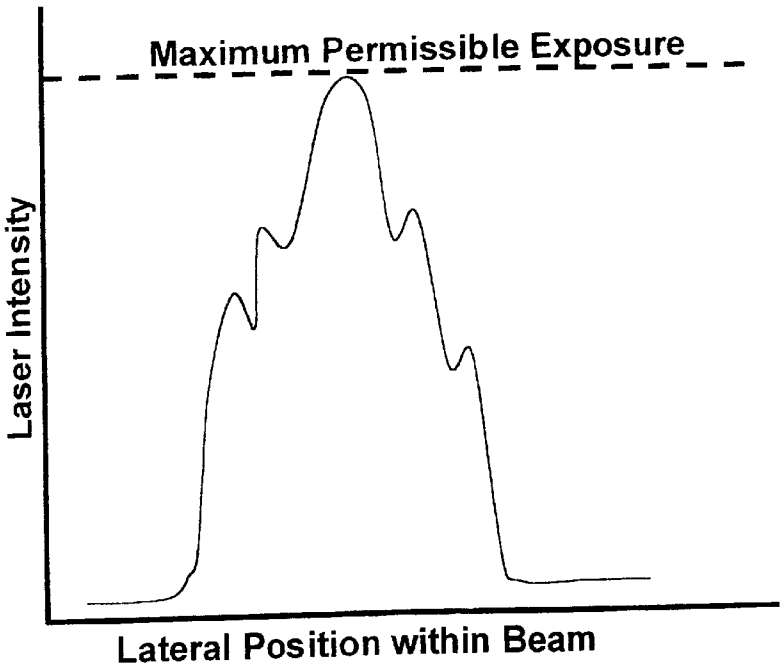
FIG. 4*a* is a graphic representation of a laser output beam having a strong central intensity peak.

The output beams produced by most lasers are not of uniform intensity throughout the beam area but rather have one or more "hot" spots. Within these hot spots, the light intensity can be several times brighter than the average intensity of the beam. For a laser beam to be eye safe, no point in the beam can exceed the MPE so if the beam has hot spots, the laser output power must be reduced to keep these areas below the MPE. The ideal laser beam for these applications would have a flat intensity profile throughout the entire beam area. FIGS. 4*a* and 4*b* of the drawings illustrate this point. The typical laser output beam of FIG. 1*a* has a strong central intensity peak that must be kept below the MPE level. However, the laser beam of FIG 1*b* is essentially flat across its entire diameter, allowing the laser output power and the brightness of the beam as seen by an adversary to be several times greater than the beam in FIG. 4*a*.

In some cases, within the bird dispersal methodology of the present invention, it is beneficial to alter the output pattern of a light source or light emitter in order to achieve illumination that is more uniform than otherwise possible from the light emitter. For example, typical semiconductor laser diodes emit light that is highly divergent in one direction and much less divergent in the perpendicular direction. The result is an illumination pattern that is rectangular, often 20 times wider in one direction (up and down, for example) than in the perpendicular direction (left and right, for example). In this case, in order to achieve more uniform illumination, it is beneficial to alter the output pattern by focusing the semiconductor laser diode's light into an optical fiber. Light emitted from the distal end of the fiber is then made more uniform by the physical properties of the optical fiber. The rectangular emission pattern of light emission from the semiconductor laser diode is altered, by focusing the light into an optical fiber and into a round and uniform illumination pattern. A more detailed description of the optical fibers and their relationship with the light sources is provided below with respect to FIGS. 5 through 7.

In the embodiment of the present invention related to the use of LEDs as a light source or light emitter, the light emitter output pattern is already relatively uniform. It should be realized that focusing the emitter's light into an optical fiber will still improve the uniformity of the illumination pattern. However, with such a relatively uniform emitter, it may be possible to achieve sufficiently uniform illumination without the use of an optical fiber.

Another element of cost in an eye-safe laser device derives from the need to ensure that the light intensity never exceeds the MPE. Special electronic circuitry is required to sense the light output level from the laser and adjust it downward if it begins to increase due to temperature or aging effects inherent in the laser design. Because light from non-laser sources such as LEDs of the type utilized with the present invention is not coherent, it cannot be focussed to as small a spot on the retina as is possible with laser light. Consequently, the possibility of injury for non-laser sources is greatly reduced and, therefore, no U.S. standard for safe LED exposure levels has been established. Because there is no need to control the LED output level for safety purposes, further cost reduction is possible by elimination of the output control circuitry.

A further preferred embodiment of the present invention utilizes at least two colors of light within the device to substantially improve the effectiveness when used to produce disorientation of birds in the flashing mode. By the incorporation within the device of electronic circuitry as described in detail with respect to FIGS. 10 and 11 of the drawings, to sequentially flash first one color light source then another color light source in repeated cycles, enables the disorientation affect to be significantly greater than that produced by a single-color on-off flashing light.

Figure 5:
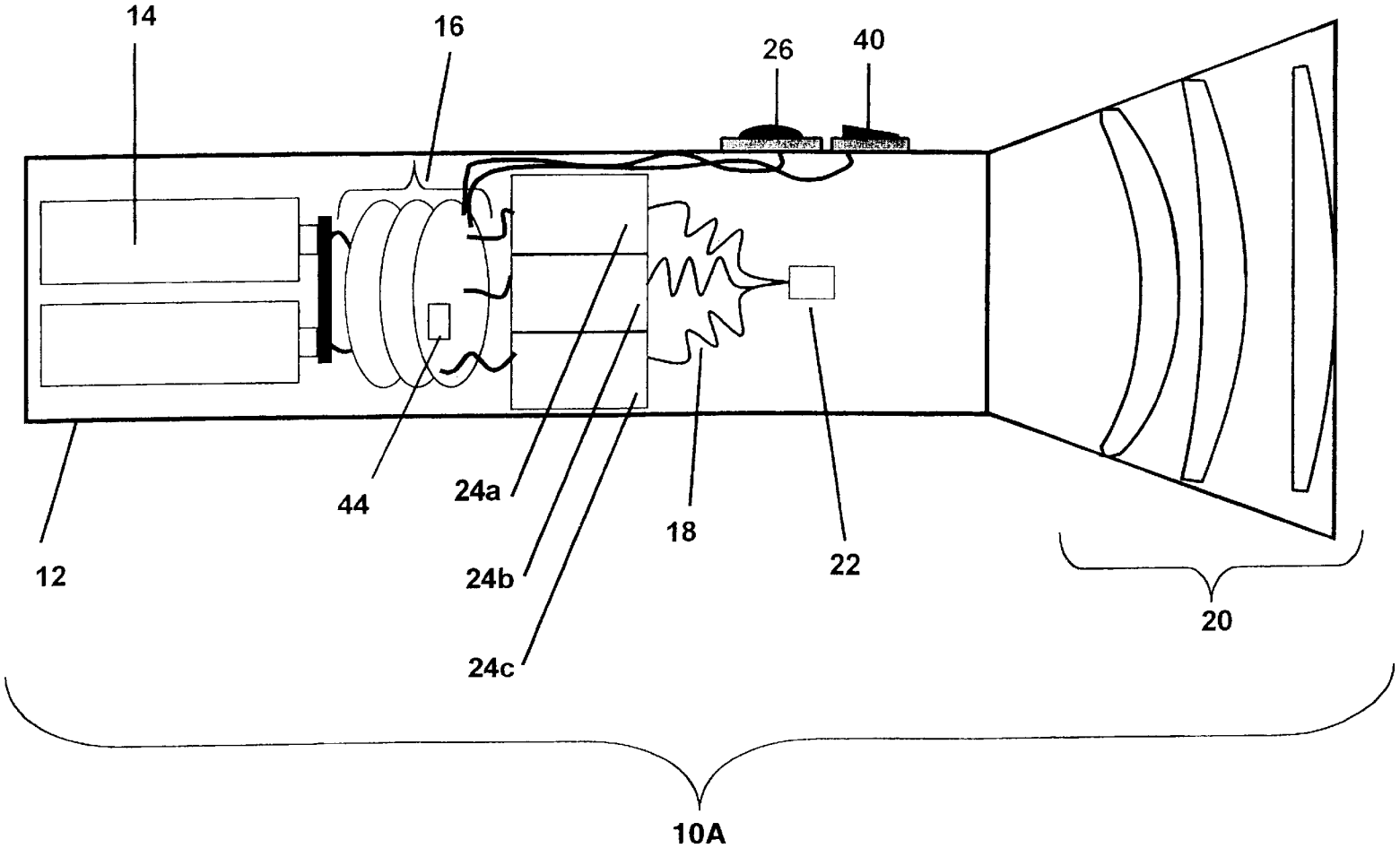
FIG. 5 is a schematic representation of a preferred embodiment of the present invention using multiple laser light sources.

Reference is now made to FIGS. 5–11 of the drawings for a more detailed description of the inventive embodiments where, for ease of understanding of the invention, like reference numerals will be used for substantially identical components. FIG. 5 of the drawings illustrates the preferred embodiment of the invention in the form of a handheld device or system 10A which incorporates therein the use of light sources of different wavelengths (or a single laser capable of multiple wavelengths. It should also be realized, however, that the present invention is not limited to handheld devices.

As shown in FIG. 5, the various components of this invention are contained within a rugged housing 12. All components are contained within housing 12, preferably made of aluminum, which is also preferably sealed and weatherproof. The function of the housing 12 is to provide protection to the internal components and to provide a rigid structure for all optical and electronic components. Within the housing 12 reside power source 14, preferably in the form of batteries (although a DC power supply can also be used), multiple lasers, each laser emitting light of a different color. For example, laser 24*a* is preferably red in color (Applied Optronics Corporation, AOC-670-250Z-T3), laser 24*b* is preferably green in color (Casix, DPGL-1050), and, if desired, a third laser 24*c* is preferably blue in color. It is also possible to use even additional lasers of different colors. Each laser is aligned into respective coiled optical fibers 18 (for example, Mitshubishi, SK-10 Optical Grade Fibers). A fiber coupling unit 22 (for example, Thor Labs, Inc., 10770A, SMA Connector) serves to bring the multiple coiled fibers 18 to a single output point. Any suitable optical lens assembly 20 (for, example, Lens 1 Optimax Corporation, Custom Spherical, Lens 2 Optimax Corporation, Custom Spherical, Lens 3 Newport Corporation, KPX-232) shapes the beam, provides uniform intensity distribution, and collimates the beam. The optical lens assembly 20 preferably has some adjustablility in order to obtain a desired spot size for the particular application. This adjustablility feature is described in U.S. Pat. No. 6,007,218. The device 10A is activated using a momentary ON/OFF activation switch 26 located on the outside of housing 12 in a manner similar to that described in U.S. Pat. Nos. 5,685,636 and 6,007,218. A multi-position switch 40 is used to select which laser or lasers will be activated in a manner as set forth in detail below.

Figure 10:
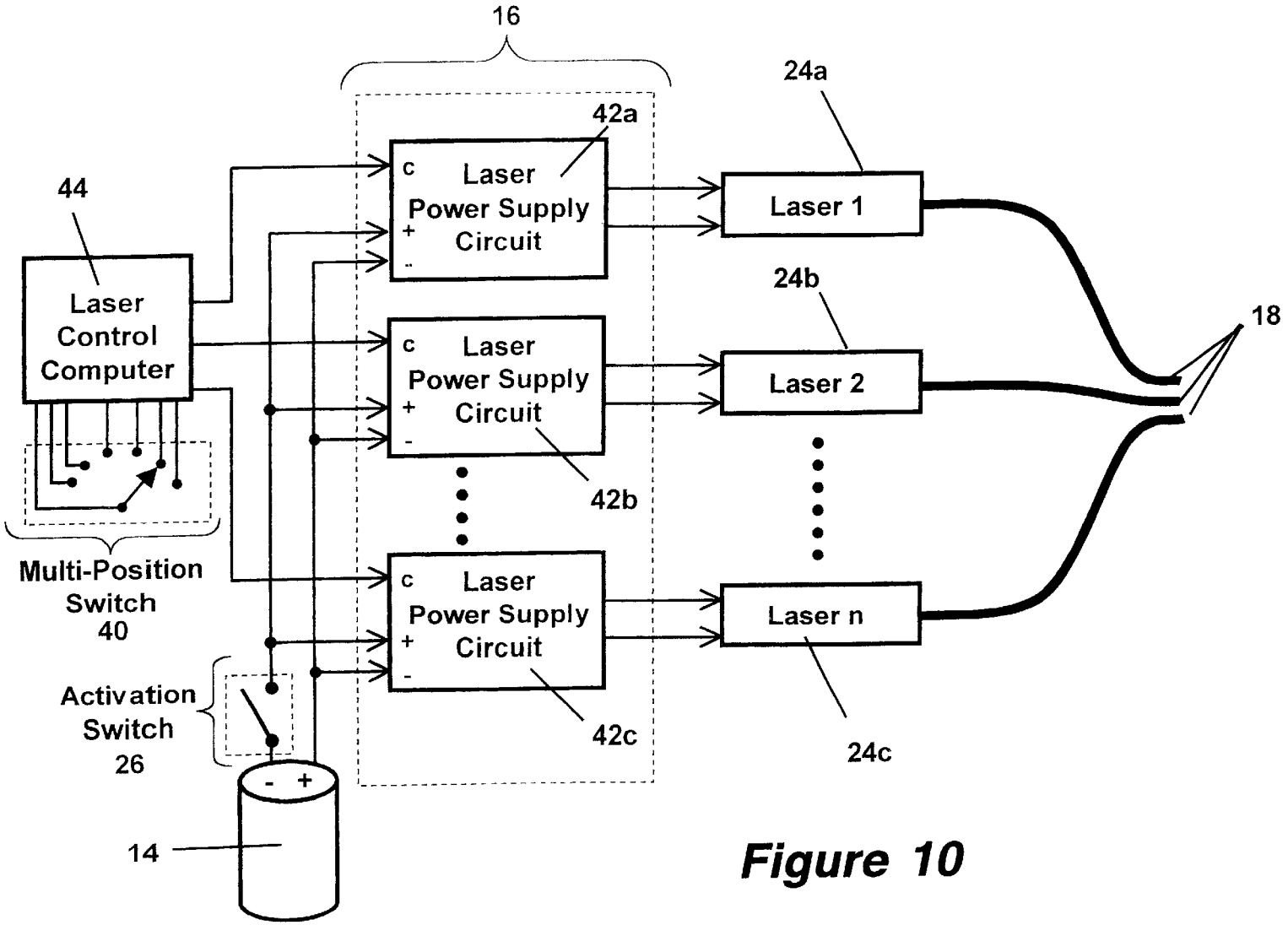
FIG. 10 is a schematic representation of the electronics and control circuitry used to power multiple lasers.
Figure 11:
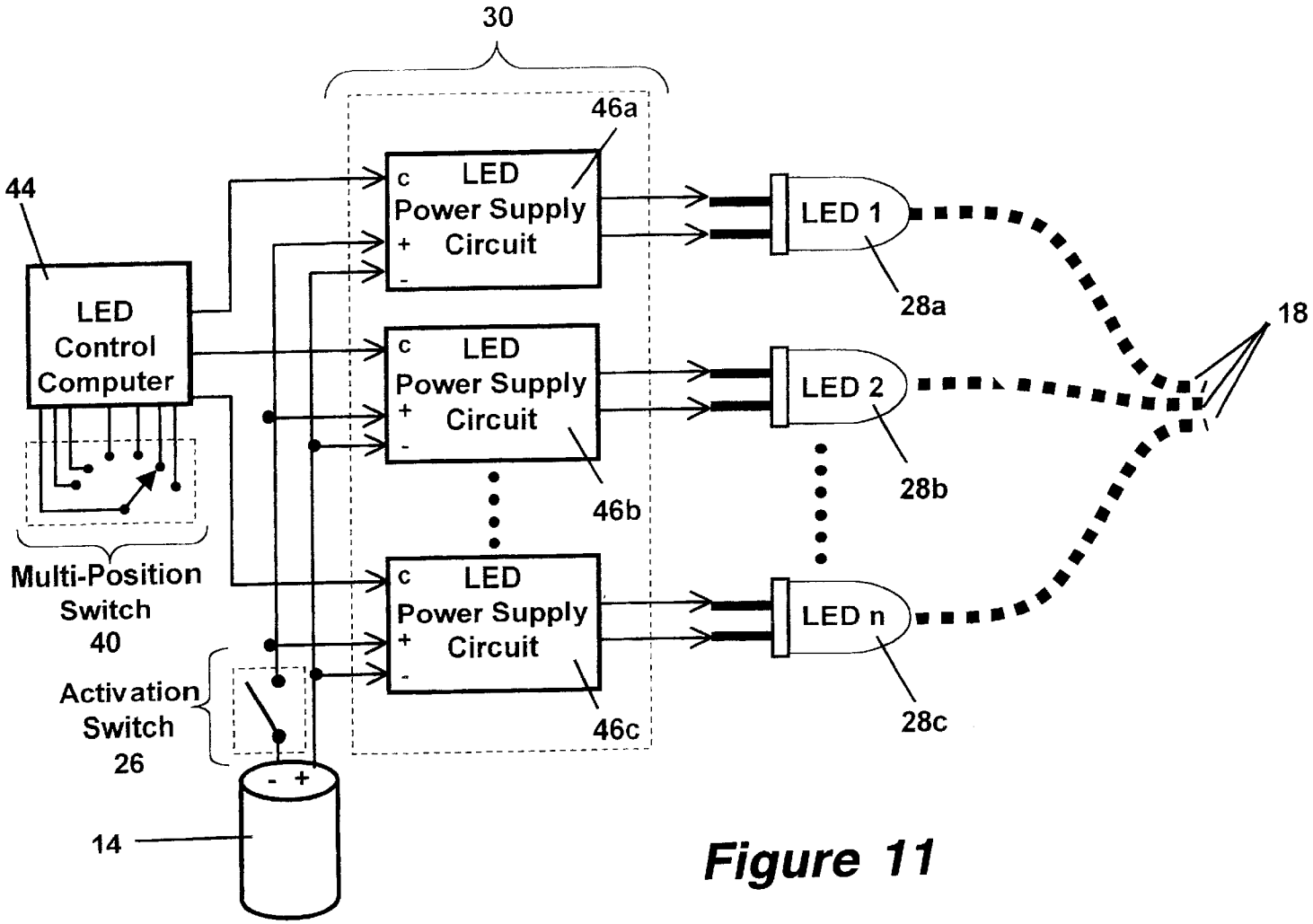
FIG. 11 is a schematic representation of the electronics used to drive multiple LEDs.

All of the embodiments of the present invention are capable of activating several modes using the multi-position switch 40 and the momentary ON/OFF switch 26 and the control computer 44 (described in more detail with respect to FIGS. 10 and 11. One mode of operation would allow continuous ON mode for one or more of the selected light sources. For example, red green, or blue light sources would be emitted continuously from the device. Additionally, another mode of operation would allow for flickering (blinking) of one or more selected light emitting sources. For example, red, green or blue light sources flickering at the same time (in phase). Another mode would involve flickering selected light sources in an offset manner, perhaps completely out of phase from each other. For example, red and green light sources flickering at the same frequency such that the red source is ON while the green source is OFF, so that light emitted from the device alternates red, green, red, green, etc. Also, another mode of operation would consist of flickering selected light sources at different frequencies. For example, a red source flickers 8 times per second, a green source flickers 12 times per second and a blue source at 16 times per second. Finally, any number of modes consisting of a combination of those just described. For example, a blue light emits continuously while red and green sources flicker (either at the same time, or offset, or at different frequencies).

In the present invention multi-position switch 40 is capable of activating the modes described above. For example, continuous ON mode for all lasers 24*a,* 24*b,* 24*c,* continuous ON mode for selected lasers, such as 24*a,* 24*b,* flicker (or blinking) mode for all lasers 24*a,* 24*b,* 24*c,* and flicker mode of only select color lasers 24*a,* 24*b,* 24*c* at various flicker frequencies. In addition, the flicker mode of operation could also be controlled with the momentary ON/OFF switch 26 by incorporating a delay or timer circuit. In this scenario, if the momentary ON/OFF switch 26 is activated, continuous light may be emitted from the beam for 5 seconds, then the device would automatically engage flicker or flashing mode. Depressing of the momentary ON/OFF activation switch 26 activates the device or system 10A once a setting has been selected with the multi-position switch 40. It would also be desirable to change the multi-position switch 40 while the main momentary ON/OFF switch 26 is engaged. With the present invention, a flash rate of approximately 8 Hz provides optimal disorientation for on-off flashing. If the light is flashed between two colors in different parts of the visible spectrum (red and green or red and blue for example) rather than on and off, the disorientation is enhanced because the eye is trying to adapt.

Figure 7:
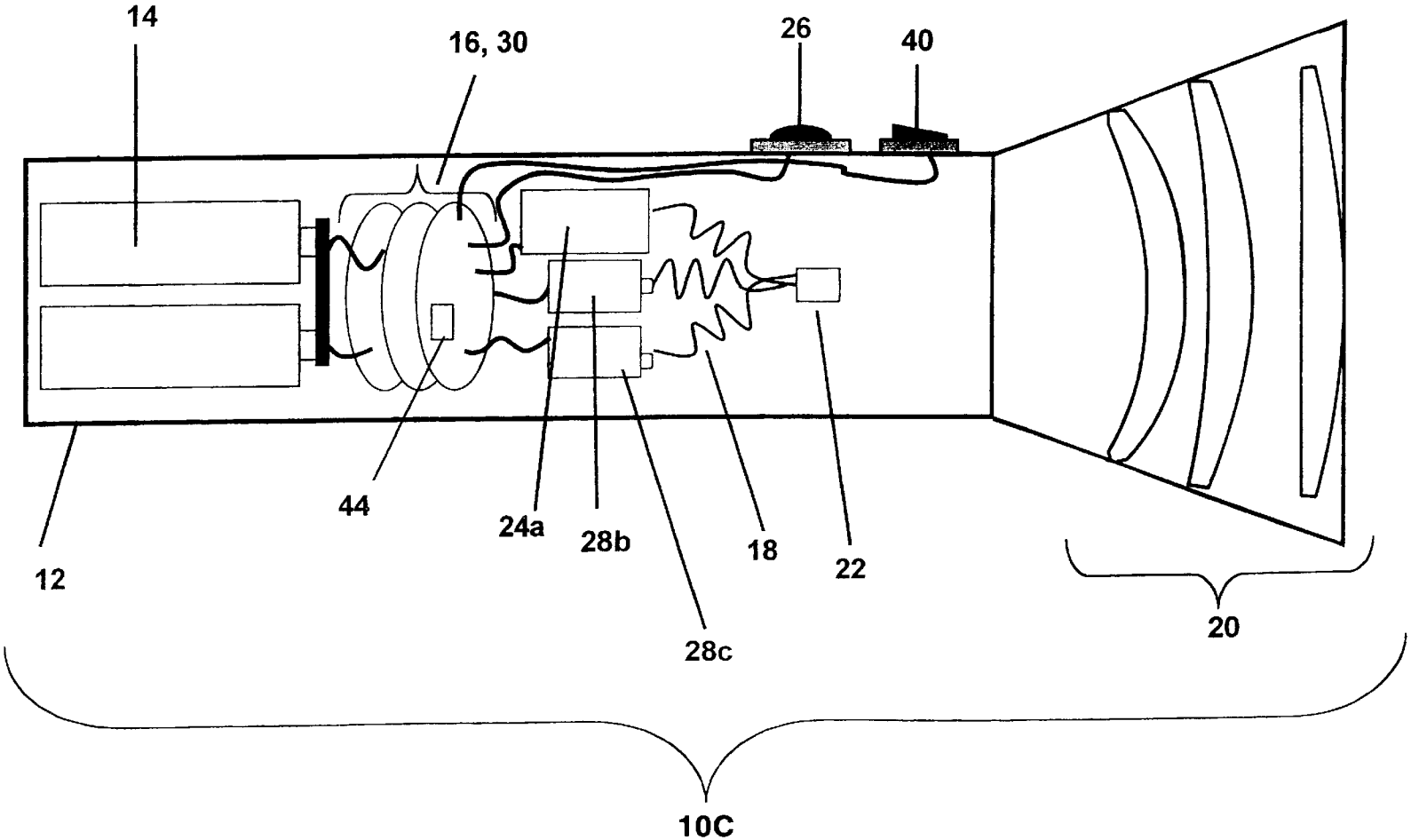
FIG. 7 is a schematic representation of still another embodiment of the present invention utilizing a hybrid laser/LED light source.

The electronics 16 used with the lasers are also preferably located inside the housing 12 and are described in detail in U.S. Pat. No. 6,007,218 which as stated above is incorporated herein by reference. FIG. 7 and its associated description provided below also explains electronics 16. It is important that each laser 24*a,* 24*b,* and 24*c* be kept at a constant intensity output in order to ensure eye safe levels of exposure and proper operation/lifetime of the laser 24*a,* 24*b,* 24*c*. The electronics 16 are equipped with monitor-photodiode feedback circuits to keep the output intensity level of the lasers 24*a,* 24*b,* 24*c* constant.

Still referring to FIG. 5, each laser 24*a,* 24*b,* 24*c* has a respective coiled optical fiber 18 associated with it. The optical fibers 18 are aligned with their respective laser 24*a,* 24*b,* or 24*c* to provide good optical throughput. The fibers are coiled into multiple loops in order to "mix-up" or "homogenize" the output beam. Reference is made to U.S. Pat. No. 6,007,218 for additional fiber coiling information. This coiling also keeps the intensity profile of the output beam to be very nearly constant throughout the beam area as shown in FIG. 4*b*. The output end of the coiled fibers 18 are assembled into a conventional coupling device 22 which is mounted near the focal point of the optical lens assembly 20.

Figure 6:
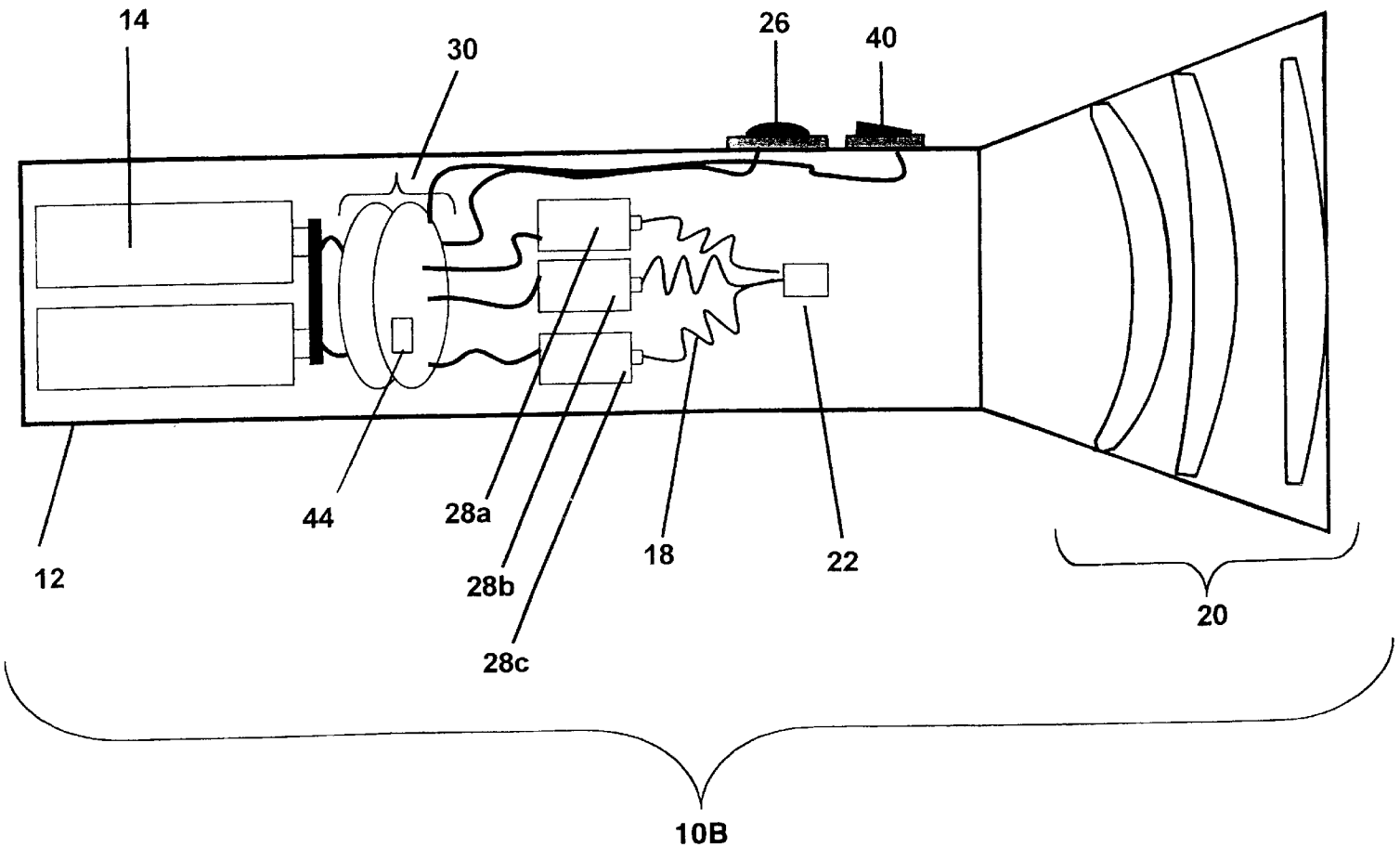
FIG. 6 is a schematic representation of another embodiment of the present invention using multiple light-emitting diodes (LED) light sources.
Figure 8:
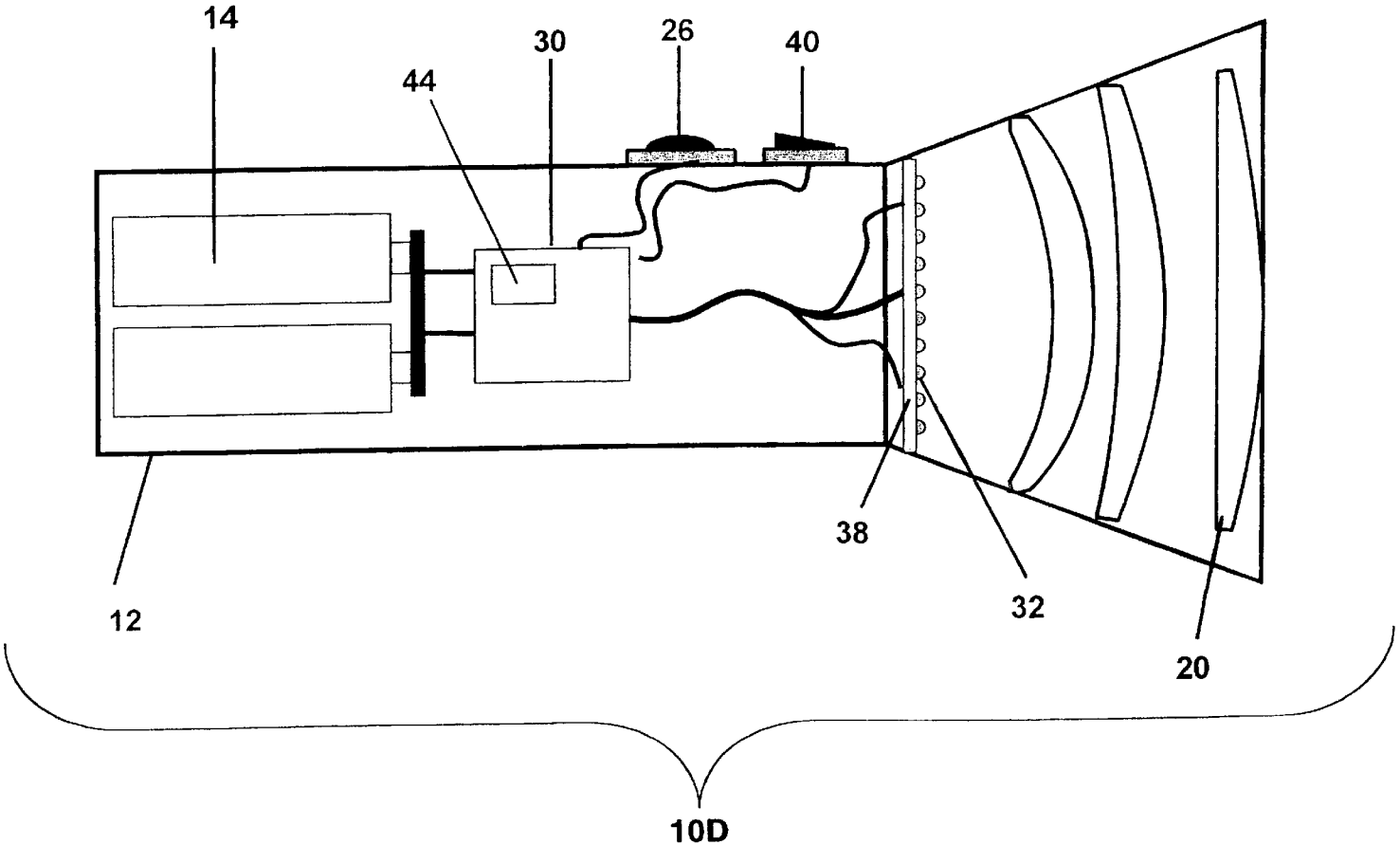
FIG. 8 is a schematic representation of a further embodiment of the present invention using an LED array.

FIG. 6 shows a variation of the preferred embodiment of FIG. 5 in which security device or system 10B uses multiple LEDs 28*a,* 28*b* and 28*c* in place of the multiple lasers 24*a,* 24*b* and 24*c,* respectively. Contained within housing 12 are multiple LEDs 28*a* (preferably red in color, OptoTechnology OTL-660a-3-4-66E or Gilway Technical Lamp, E184), 28*b* (preferably green in color, OptoTechnology OTL530a-9-4-66E or Gilway Technical Lamp, E903), and 28*c* (preferably blue in color, OptoTechnology OTL-470-3-4-66E or Gilway Technical Lamp, E474). The LEDs 28*a,* 28*b,* and 28*c* may be fiber coupled using a coiled optical fiber 18 for each LED. Also, the LEDs could be arranged in an array 32 as shown in FIG. 8. Still referring to FIG. 6, the LEDs 28*a,* 28*b,* 28*c* are aligned with each coiled fiber 18, respectively. Coiling is necessary if beam shaping is needed. If the unmodified output of the LED is "round" or uniformly shaped, it may not be necessary to use a coiled fiber. However, if space inside a housing is limited, fibers may be used to "guide" the beam location where it may be imaged. Once coiled, the fibers 18 are polished. Polishing of fibers is commonly accomplished by sanding the fiber face with sequentially higher grit sandpaper until the desired finish is attained. Once polished, the fibers 18 are collected together in a conventional fiber coupling device 22. Any suitable optical lens assembly 20 is used to shape the beam for a variety of uses. A lens assembly that diverges the beam quickly may be useful for short-range applications, and a lens assembly that has a small divergence or is collimated is preferred for long range applications. Adjustment in the placement of the lens assembly 20 may be desirable in order to have additional options of spot size. A momentary ON/OFF switch 26 and multi-position switch 40 are used to activate the device or system 10B in a variety of modes as discussed above with respect to the embodiment of FIG. 5.

It is important to note that the electronics 30 (described in detail with respect to FIG. 11) used to drive the LEDs 28*a,* 28*b,* and 28*c* is very simplified from the circuitry used with the lasers. LEDs are easy to power with only batteries 14 and a simple voltage regulator integrated circuit and associated resistors and capacitors while the circuitry of electronics 16 requires sophisticated power supply circuitry. LEDs are cost effective and have a long, stable lifetime, therefore a monitor photodiode or other sophisticated electronics are not needed. Less sophisticated electronics along with low LED prices make this embodiment very cost effective for short range applications.

FIG. 7 depicts a hybrid version of the invention as embodied in device 10C in which both a laser 24*a* and LEDs 28*b,* 28*c* are used to provide an effective bird dispersal device, although the exact combination of lasers and LEDs may vary within the scope of this invention. This embodiment of the invention is desirable in order obtain a good mix of output power with cost effectiveness. Preferably laser 24*a* is red in color, small, compact, and commonly available. LEDs 28*b,* and 28*c* provide green and blue light, respectively. All of the light sources 24*a,* 28*b,* and 28*c* may be coupled with respective optical fibers 18 and brought together at a fiber coupling device 22. Once again, any suitable optical lens assembly 20 gives beam shaping capabilities to the output beam(s). The electronics 16 are moderately sophisticated, a portion of the electronics 16 must be able to provided constant current to the laser 24*a* (such as laser power supply circuit 42*a* as shown in FIG. 10). The LED electronics 30 needed to supply power to the light sources 18*b* and 28*c* require only simple voltage regulator integrated circuits (such as shown by the LED power supply circuits in FIG. 11) in order to operate within specification. The batteries 14 provide power to the device 10C. A momentary ON/OFF activation switch 26 activates the device 10C. The device 10C can be activated in several modes including both continuous and flicker of one or more light sources 24*a,* 28*b,* and 28*c* using the multi-position switch 40. This embodiment of the invention is very versatile and provides effective long and short range capability.

FIG. 8 of the drawings depicts another embodiment of the preferred embodiment. The light source in the device 10D of this embodiment is in the form of an array of LEDs 32 mounted to a base such as a printed circuit board (PCB) 38. This embodiment of the invention is simply powered by the batteries 14 and electronics module 30 of the type described with reference to FIG. 2 above and FIG. 8 below. Once again any suitable optical lens assembly 20 may be used to shape or focus the output beam. A momentary switch 26 provides activation to the system 10D in a variety of modes as described hereinabove.

Figure 9:
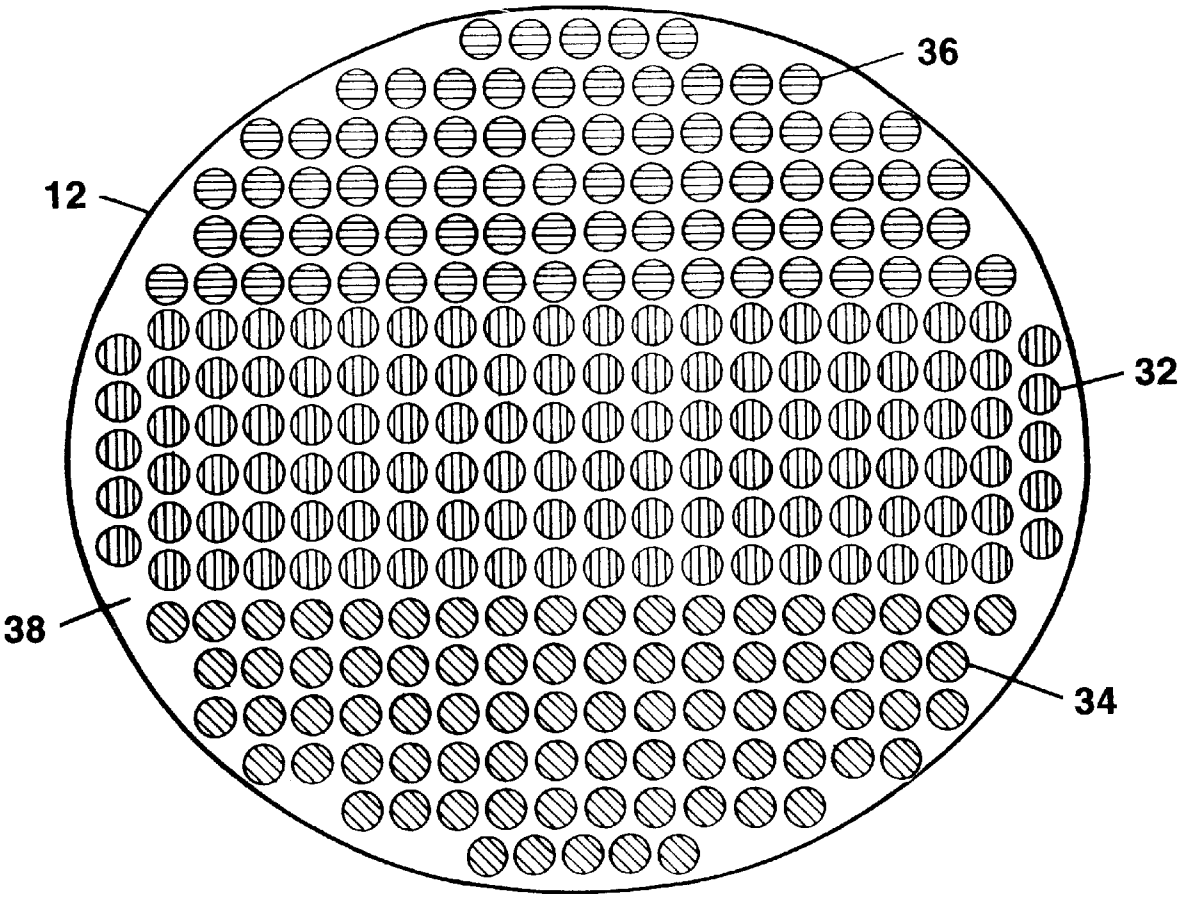
FIG. 9 is a front view of the LED array utilized in the embodiment of FIG. 5.

FIG. 9 illustrates a front view of the LED array 32 used in the above embodiment. An array 32 of multicolored LEDs (red), 34 (green), 36 (blue) are mounted on the base 38. This array 32 is then mounted into the housing 12. An optical lens assembly (not shown in this figure) may be needed to shape the outcoming beam.

Reference is now made more specifically to the electronics 16 and 30 utilized within the various embodiments of this invention. FIG. 10 is a schematic of the electronic circuitry 16 that provides for sequentially flashing multiple lasers. Each laser 24*a,* 24*b* and 24*c* is powered by a separate laser power supply circuit 42*a,* 42*b* and 42*c,* respectively. Each of the power supply circuits 42*a,* 42*b* and 42*c* is preferably identical in design to the Laser Diode Switching Power Supply Circuit in U.S. Pat. Nos. 5,685,636 and 5,685,636, both of which as stated above being incorporated herein by reference. The power supply circuits 42*a,* 42*b,* and 42*c* provide the well-regulated, constant-current electrical power required for safe operation of semiconductor laser diodes. A laser control computer 44 utilizing, for example, an inexpensive Programmable Integrated Circuit (PIC) (Microchip Technology, Inc., PIC12CE67X), provides individual ON/OFF control signals to the control input pins of the multiple power supply circuits 42*a,* 42*b,* and 42*c.* The PIC contained within the laser control computer 44 is programmed to provide the appropriate ON/OFF control signals in response to a multi-position switch 40, which is set by the user to select operating modes. Battery power 14 provides DC electrical power to the laser power supply circuits 42*a,* 42*b,* and 42*c* and the laser control computer 44 whenever the momentary ON/OFF activation switch 26 is depressed by the user to activate the security device 10A.

FIG. 11 is a schematic of the electronic circuitry 30 that provides for sequentially flashing multiple LEDs. The operation of the LED control circuit 30 is basically identical to that described for the multiple laser control circuit 16 shown in FIG. 10. As with circuitry 16, a PIC based control computer 44 is programmed to provide the appropriate ON/OFF control signals in response to a multi-position switch 40 whenever the momentary ON/OFF activation switch 26 is depressed. However, it is important to note that the LED power supply circuits 46*a,* 46*b,* and 46*c* differ from the laser power supply circuit 42*a,* 42*b,* and 42*c* of FIG. 10. The lasers (24*a,* 24*b,* and 24*c* shown in FIG. 10) require a complex switching power supply to provide a constant current. The LEDs, however, require only simple voltage regulator integrated circuits 46*a,* 46*b,* and 46*c* (Micrel Semiconductor, MIC2951), respectively. Such voltage regulator integrated circuits are very inexpensive, usually costing substantially less than the laser power supply circuits 42*a,* 42*b,* and 42*c.* The power supply cost difference, when combined with the very large cost difference between laser diodes and LEDs, provides embodiments of the present invention which are economically attractive.

Figure 12:
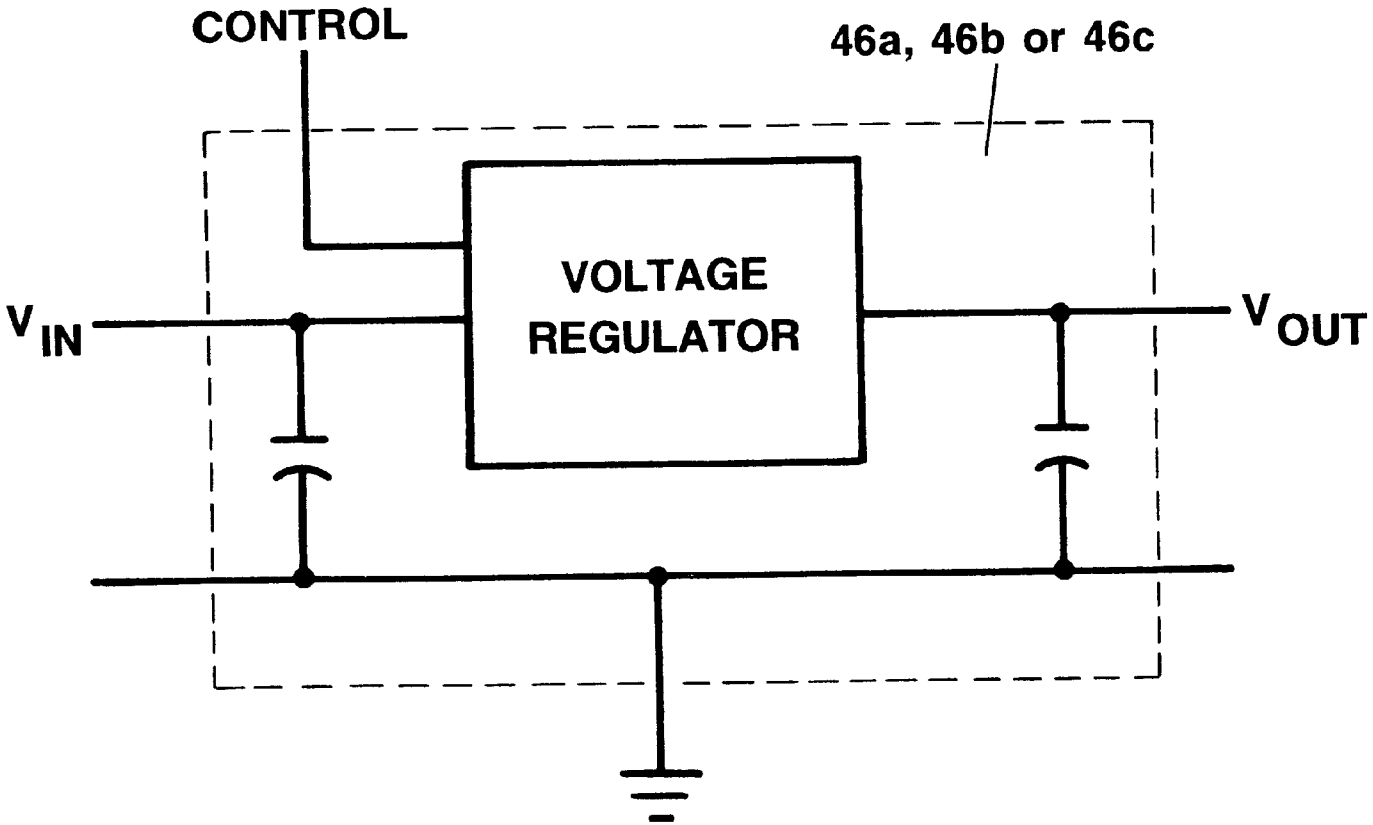
FIG. 12 is a schematic representation of the LED power supply circuit.

FIG. 12 is a schematic of the LED power supply circuit 46*a,* 46*b,* or 46*c* that provides operation of the LEDs. A simple commercial-off-the-shelf (COTS) voltage regulator circuit provides the electronics with a voltage in, voltage out, control signal, and common ground. This circuit is highly simplified from the laser power supply circuit (42*a,* 42*b* or 42*c*) and the laser power supply circuitry depicted in U.S. Pat. No. 5,685,636.

Figure 13:
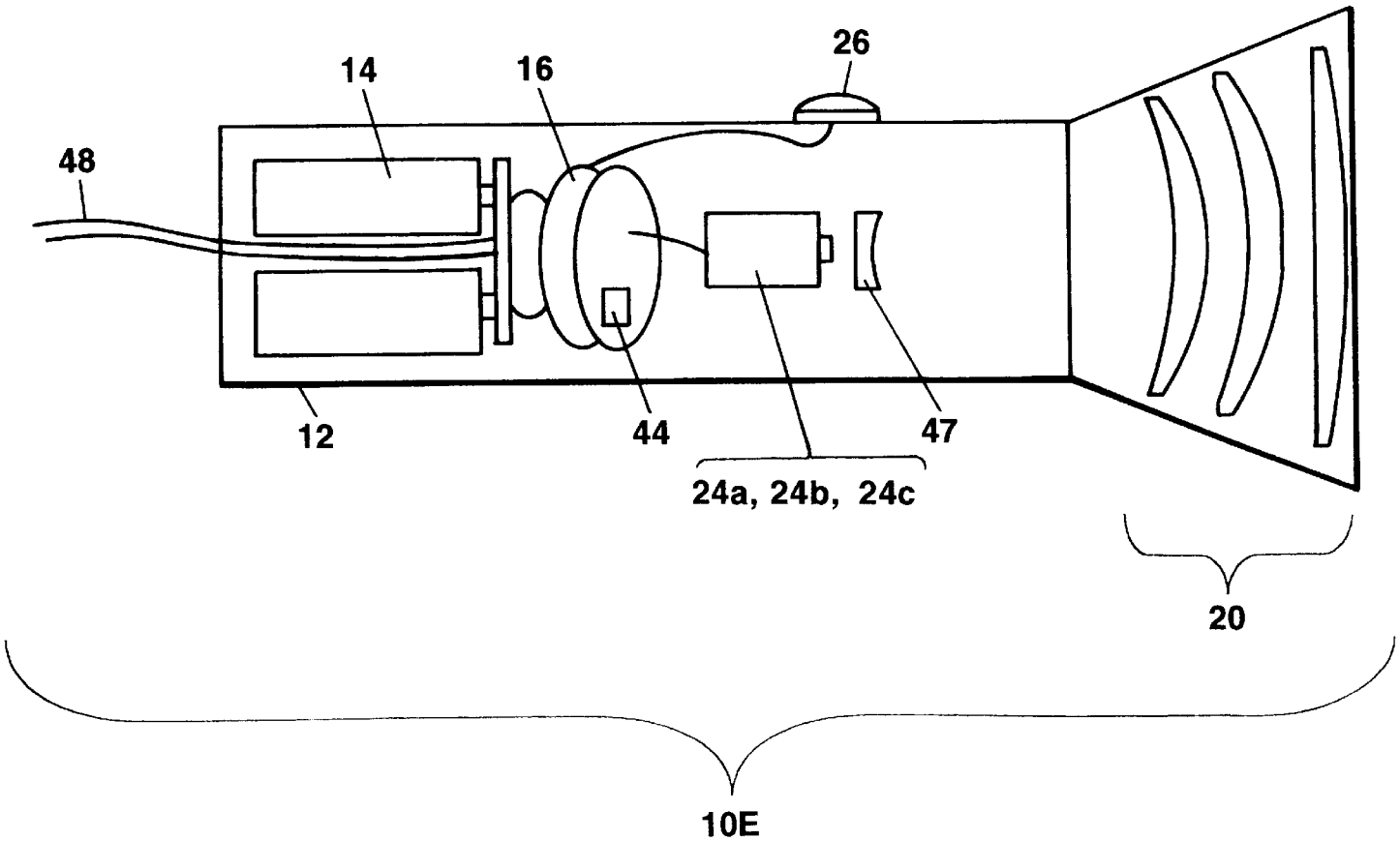
FIG. 13 is a schematic representation of still another embodiment of the present invention for direct coupling of laser diode to produce an eye-safe laser beam.

FIG. 13 of the drawings depicts another embodiment of the preferred embodiment of the bird dispersal contained within rugged housing 12. The light source in the device 10E of this embodiment is in the form of a single laser 24*a,* 24*b,* or 24*c.* The light output of laser 24*a,* 24*b,* or 24*c* is simply projected through beam expanding lens 47 in place of fiber coupling. It should be noted that the beam expanding lens 47 may be either positive or negative in optical power. Once again any suitable optical lens assembly 20 may be used to shape or focus the output beam. This embodiment of the invention is simply powered by the batteries 14 or external power supply via DC power leads 48 and electronics 16 of the type described with reference to FIG. 5 above. A momentary switch 26 provides activation to the system 10E in a variety of modes as described hereinabove. The system 10E may also be activated by computer control 44.

Figure 14:
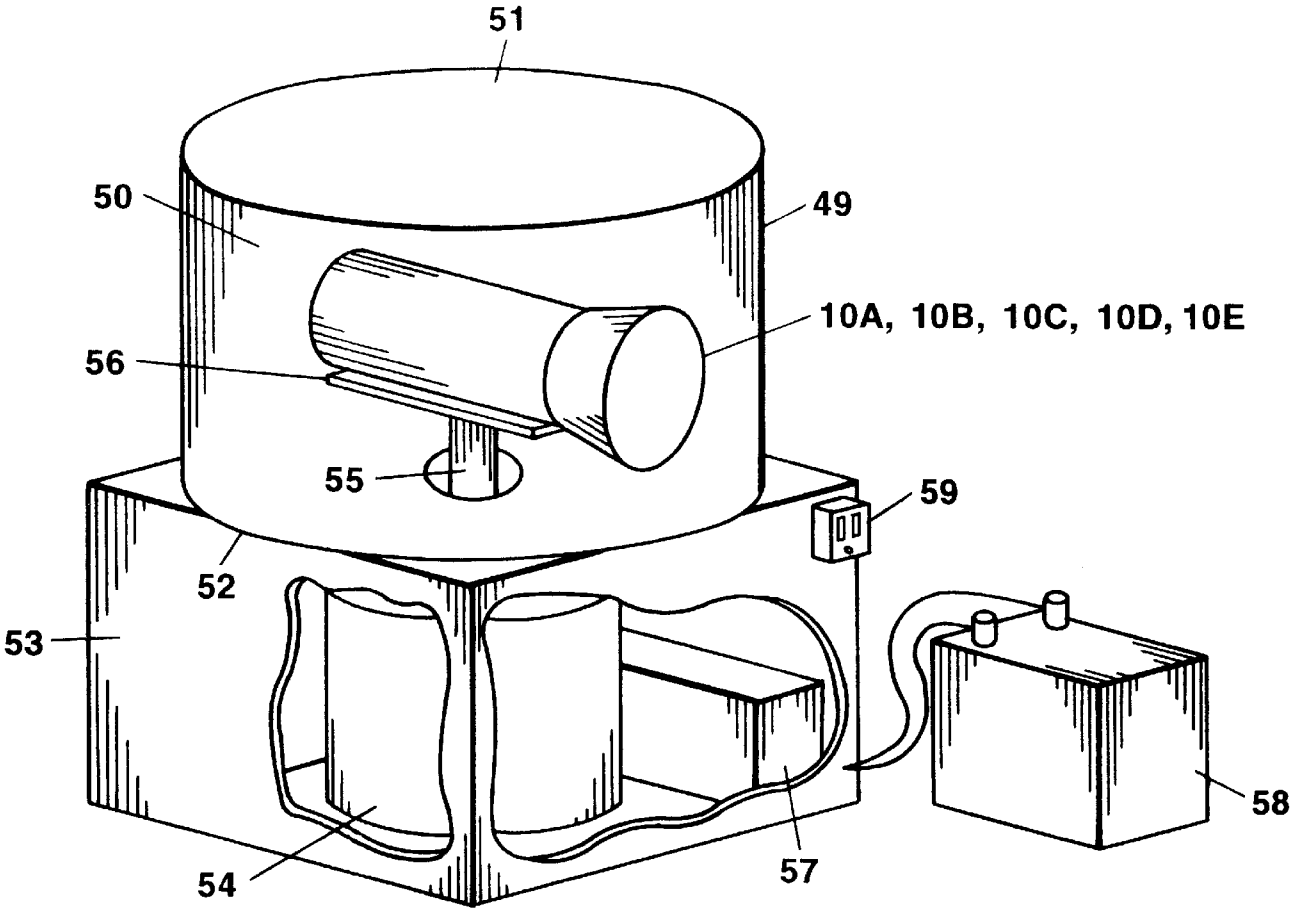
FIG. 14 is a schematic representation of still another embodiment of the present invention for utilizing an automated scanning system.

FIG. 14 of the drawings depicts still another embodiment of the invention. This embodiment of the invention depicts device 10A, 10B, 10C, 10D, or 10E mounted inside rugged container 49. Rugged container 49 is comprised of a cylindrical section of a larger diameter tube 50 preferably, but not limited to, polycarbonate enclosed by end plates 51 and 52. Polycarbonate tube 50 is of suitable diameter to contain and mount devices 10A, 10B, 10C, 10D, or 10E and is clear in color allowing light to project from the device through the tube wall. The rugged container 49 is mounted to any suitable motor enclosure 53. Motor enclosure 53 contains a computer-controlled motor 54 with drive shaft 55 extending into, but not through rugged container 49. Devices 10A, 10B, 10C, 10D, or 10E are mounted to drive shaft 55 via device mount 56. When activated, the motor 54 rotates drive shaft 55 and the eye-safe device in a random or predetermined manner, such as scanning. The motor 54 is controlled via computer control 57 and is externally powered by battery 58 or any available AC power supply via AC power plug 59.

This systemized utilization of a high intensity light source as set forth in the present invention directed in areas known to be frequented by nuisance birds or the like, provides a cost effective, efficient way to rid the area of such birds without harming the birds, humans or property.

Although the invention has been described with respect to various embodiments, it should be realized this invention is also capable of a wide variety of further and other embodiments within the spirit and scope of the appended claims.

What is claimed is:

1. A device to produce a bright light for use in non-lethally dispersing birds from a preselected area, comprising:

at least one laser diode light source, said at least one laser diode light source capable of producing a beam of light within a wavelength region of 400–700 nanometers;.

a housing, said housing being transparent to light at said wavelength region;

a rotatable member extending within said housing;

said at least one laser diode light source being mounted upon said rotatable member;

means for periodically activating said at least one laser diode light source;

means operably connected to said rotatable member for controllably regulating the rotation of said rotatable member such that said rotatable member may be rotated in a predetermined or random fashion; and said at least one laser diode light source having means associated therewith for limiting the intensity of the at least one laser diode output beam to fall below the Maximum Permissible Exposure (MPE) as recognized by the American National Standards Institute in order to prevent eye damage to humans;

whereby said device can be readily placed or mounted within the vicinity of birds to be dispersed.

2. A non-lethal method of dispersing birds from a preselected area, comprising the steps of:

determining the area from which the birds are to be dispersed;

providing at least one laser diode light source;

activating said at least one laser diode light source to produce at least one beam of bright light within a wavelength region of 400–700 nanometers;

providing a housing for said at least one laser diode light source, said housing being transparent to light at said wavelength region;

rotating said at least one laser diode light source within said housing in a predetermined or random fashion;

substantially simultaneously with said rotating step, periodically activating said at least one laser diode light source; and providing means for said at least one laser diode light source for limiting the intensity of the at least one laser diode output beam to fall below the Maximum Permissible Exposure (MPE) as recognized by the American National Standards Institute in order to prevent eye damage to humans;

whereby rotation of said at least one laser diode light source directs said at least one beam of bright light in the vicinity of the birds to be dispersed thereby causing the birds to become sufficiently startled so as to disperse from the area.

* * * * *